US009624826B2

(12) United States Patent
Roberts

(10) Patent No.: US 9,624,826 B2
(45) Date of Patent: Apr. 18, 2017

(54) VARIABLE COMPRESSION CYLINDER HEAD, CRANKSHAFT, AND PISTON ROD AND SYSTEM THEREOF

(71) Applicant: Freddie Ray Roberts, Clarksville, TN (US)

(72) Inventor: Freddie Ray Roberts, Clarksville, TN (US)

( * ) Notice: Subject to any disclaimer, the term of this patent is extended or adjusted under 35 U.S.C. 154(b) by 0 days.

(21) Appl. No.: 14/661,739

(22) Filed: Mar. 18, 2015

(65) Prior Publication Data

US 2015/0267608 A1 Sep. 24, 2015

Related U.S. Application Data

(60) Provisional application No. 61/967,638, filed on Mar. 24, 2014, provisional application No. 61/967,640, filed on Mar. 24, 2014, provisional application No. 61/967,639, filed on Mar. 24, 2014.

(51) Int. Cl.
*F02B 75/04* (2006.01)

(52) U.S. Cl.
CPC ..... *F02B 75/042* (2013.01); *F02B 75/045* (2013.01); *F02B 75/048* (2013.01)

(58) Field of Classification Search
CPC ..... F02B 75/04; F02B 75/041; F02B 75/042; F02B 75/045; F02B 75/047; F02B 75/048; F02D 15/00; F02D 15/02; F02D 15/04
USPC ..... 123/48 R, 48 A, 48 AA, 48 B, 78 A, 123/78 AA, 78 E, 46 R
See application file for complete search history.

(56) References Cited

U.S. PATENT DOCUMENTS 1,167,023 A * 1/1916 Schmidt ..... F02B 75/042 123/66
2,758,582 A * 8/1956 Humphreys ..... F02D 15/04 123/48 AA
4,187,808 A * 2/1980 Audoux ..... F02D 15/04 123/47 R
4,987,863 A * 1/1991 Daly ..... F02D 15/04 123/48 AA (Continued)

FOREIGN PATENT DOCUMENTS

JP 59063340 A * 4/1984

OTHER PUBLICATIONS

Translation of Specification, JP59063340, Engine With Adjustable Compression Ratio, translated Oct. 2015, Phoenix Translations, pp. 1-13.*

*Primary Examiner* — Grant Moubry
(74) *Attorney, Agent, or Firm* — Pitts & Lake, P.C.

(57) ABSTRACT

A variable compression cylinder head assembly usable with an internal combustion engine having at least one piston, the cylinder head assembly including a cylinder head housing having a combustion chamber formed therein, a compression control piston disposed within the combustion chamber, a compression head actuator coupled to the cylinder head housing, the compression head actuator including an actuator housing defining an actuator reservoir, a fluid port coupled to the actuator housing to receive a fluid, a movable force plate disposed within the actuator reservoir and coupled to the compression control piston, wherein the force plate and the compression control piston move between a first position and a second position when the fluid enters the actuator reservoir.

9 Claims, 13 Drawing Sheets

(56) References Cited

U.S. PATENT DOCUMENTS

| | | | | | |
|---|---|---|---|---|---|
| 5,476,072 | A * | 12/1995 | Guy | F02B 1/12 | 123/48 AA |
| 5,724,863 | A * | 3/1998 | Kramer | F02B 41/04 | 123/48 R |
| 6,578,533 | B1 * | 6/2003 | Gray, Jr. | F02B 1/12 | 123/48 D |
| 7,827,943 | B2 * | 11/2010 | Cannata | F02B 75/044 | 123/48 B |
| 2004/0020450 | A1 * | 2/2004 | Lawes | F01B 15/007 | 123/59.3 |

* cited by examiner

VARIABLE COMPRESSION CYLINDER HEAD, CRANKSHAFT, AND PISTON ROD AND SYSTEM THEREOF

CROSS-REFERENCE TO RELATED APPLICATIONS

This application claims the benefit of U.S. Provisional Patent Application Nos. 61/967,638, 61/967,640, and 61/967,639 filed on Mar. 24, 2014, the disclosures of which are incorporated herein in their entirety by reference.

BACKGROUND OF THE INVENTION

1. Field of the Invention

The present general inventive concept relates to a compression cylinder head for an internal combustion engine, and more particularly to a variable compression cylinder head for a linear internal combustion engine.

2. Description of the Related Art

Over the past decade, combustion engine designers and engineers have sought to improve engine performance and efficiency through the use of variable or adjustable compression ratio. The compression ratio refers to the ratio of the volume of a combustion chamber from its largest capacity to its smallest capacity, which in turn, is the ratio by which the fuel/air mixture is ignited before it is ignited.

In conventional piston driven engines, the compression ratio refers to the ratio between the volume of the cylinder and combustion chamber when the piston is at the bottom of its stroke, and the volume of the combustion chamber when the piston is at the top of its stroke. For example, for a cylinder and its combustion chamber with the piston at the bottom of its stroke having 1000 cc of air is moved to the top of its stroke, and the remaining volume inside the combustion chamber has been reduced to 100 cc, the engine has a 10:1 compression ratio.

There are several types of engines which are specifically designed for specific fuel types, such as gasoline, petrol, ethanol, diesel, natural gas, and kerosene. However, each fuel type requires different compression ratios to effectively function, and therefore a different engine.

Several engines with adjustable compression ratios have been previously developed, however, these typically include variable compression height pistons which are heavy and therefore undesirably increase reciprocating mass in the engine.

Therefore, what is desired is variable compression ratio cylinder head usable with a variety of engine types and compatible with different fuel types, requiring varying combustion ratios.

BRIEF SUMMARY OF THE INVENTION

The present general inventive concept provides a variable cylinder head designed and configured to function with conventional internal combustion engines. The variable cylinder head automatically varies a compression ratio within a combustion chamber by controlling a position of a compression control piston within the cylinder.

The present general inventive concept also provides a variable cylinder head which allows for spark and detonation to occur using the same fuel type within the same engine, while significantly reducing emissions and increasing fuel efficiency.

The present general inventive concept also provides a variable compression crankshaft designed and configured to function with the variable cylinder head according to the present general inventive concept. The variable compression crankshaft includes a movable journal which controls a stroke length of a piston, as well as the compression ratio of the engine.

The present general inventive concept also provides a hydraulically operated piston rod designed and configured to function with the variable cylinder head according to the present general inventive concept. The hydraulically operated piston rod includes valves which control an expansion and contraction of the piston rod length to thereby control a stroke length of the piston, as well as the compression ratio of the engine.

Features and/or utilities of the present general inventive concept may be achieved by providing a variable compression cylinder head assembly usable with an internal combustion engine having at least one piston, the cylinder head assembly which includes a cylinder head housing having a combustion chamber formed therein, a compression control piston disposed within the combustion chamber, a compression head actuator coupled to the cylinder head housing, the compression head actuator including an actuator housing defining an actuator reservoir, a fluid port coupled to the actuator housing to receive a fluid, a movable force plate disposed within the actuator reservoir and coupled to the compression control piston, wherein the force plate and the compression control piston move between a first position and a second position when the fluid enters the actuator reservoir.

In exemplary embodiments, a volume within the combustion chamber may be defined by the piston, the cylinder head housing, and the compression control piston varies as the compression control piston moves between the first position and the second position.

The first position of the compression control piston may correspond to a first compression ratio and the second position of the compression control piston may correspond to a second compression ratio.

In exemplary embodiments, the cylinder head assembly may further include an ignition device coupled to the compression control piston. The ignition device may include a spark plug.

In exemplary embodiments, a first end of the ignition device may be in fluid communication with the combustion chamber and an opposing second end of the ignition device may be in fluid communication with an external environment.

In exemplary embodiments, the cylinder head assembly may further include a sensor to detect characteristics of fuel provided within the combustion chamber and a controller to automatically control an amount of fluid received within the actuator reservoir based on the detected fuel characteristics.

Features and/or utilities of the present general inventive concept may also be achieved by providing a variable compression crankshaft usable with a variable compression cylinder head assembly according to the present general inventive concept, the crankshaft including a first counter-weight having a first crankshaft extending therefrom coupled to a second counter-weight having a second crankshaft extending therefrom, a first variable throw piston disposed within the first counter-weight, a second variable throw piston disposed within the second counter-weight and a variable crank throw coupled to the first and second counter-weight.

Features and/or utilities of the present general inventive concept may also be achieved by providing a variable compression crankshaft usable with a variable compression cylinder head assembly of claim 1 and with an internal combustion engine having at least one piston, the variable compression cylinder head including a cylinder head housing having a combustion chamber formed therein; a compression control piston disposed within the combustion chamber; a compression head actuator coupled to the cylinder head housing, the compression head actuator including an actuator housing defining an actuator reservoir; a fluid port coupled to the actuator housing to receive a first fluid; a movable force plate disposed within the actuator reservoir and coupled to the compression control piston, the variable compression crankshaft including at least one counter weight housing having a throw piston chamber formed therein to receive a second fluid and coupled to at least one shaft having a fluid port formed therein to input the second fluid; a throw piston movable between a first position and a second position disposed within the throw piston chamber; and a variable crank throw coupled to the throw piston and a piston, wherein the force plate and the compression control piston move between a first position and a second position when the first fluid enters the actuator reservoir, and wherein the throw piston and the variable crank throw move between the first position and the second position when the second fluid enters the throw piston chamber.

The volume within the combustion chamber defined by the at least one piston, the cylinder head housing, and the compression control piston may vary as the compression control piston moves between the first position and the second position.

The volume within the combustion chamber defined by the at least one piston, the cylinder head housing, and the compression control piston may vary as the variable crank throw moves between the first position and the second position.

The first position of the compression control piston may correspond to a first compression ratio and the second position of the compression control piston may correspond to a second compression ratio. The second compression ratio may be larger than the first compression ratio. However, the present general inventive concept is not limited thereto. That is, in alternative exemplary embodiments, the first compression ratio may be larger than the second compression ratio.

The first position of the variable crank throw may correspond to a first compression ratio and the second position of the variable crank throw may correspond to a second compression ratio.

Features and/or utilities of the present general inventive concept may also be achieved by providing a variable piston rod assembly usable with a variable compression cylinder head assembly of claim 1 and with an internal combustion engine, the variable compression cylinder head comprising a cylinder head housing having a combustion chamber formed therein; a compression control piston disposed within the combustion chamber; a compression head actuator coupled to the cylinder head housing, the compression head actuator comprising an actuator housing defining an actuator reservoir; a fluid port coupled to the actuator housing to receive a first fluid; a movable force plate disposed within the actuator reservoir and coupled to the compression control piston, the variable piston rod assembly including at least one piston disposed within the combustion chamber; a first piston rod shaft coupled to the at least one piston and movably coupled to a second piston rod shaft; and a piston chamber disposed within the second piston rod shaft having a fluid port formed therein to input a second fluid, wherein the at least one piston and the first piston rod move between a first position and a second position with respect to the second piston rod when the second fluid enters the piston chamber.

A volume within the combustion chamber defined by the at least one piston, the cylinder head housing, and the compression control piston may vary as the at least one piston and the first piston rod moves between the first position and the second position.

The first position of the at least one piston and the first piston rod may correspond to a first compression ratio and the second position of the at least one piston and the first piston rod may correspond to a second compression ratio.

BRIEF DESCRIPTION OF THE DRAWINGS

These and/or other utilities and aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
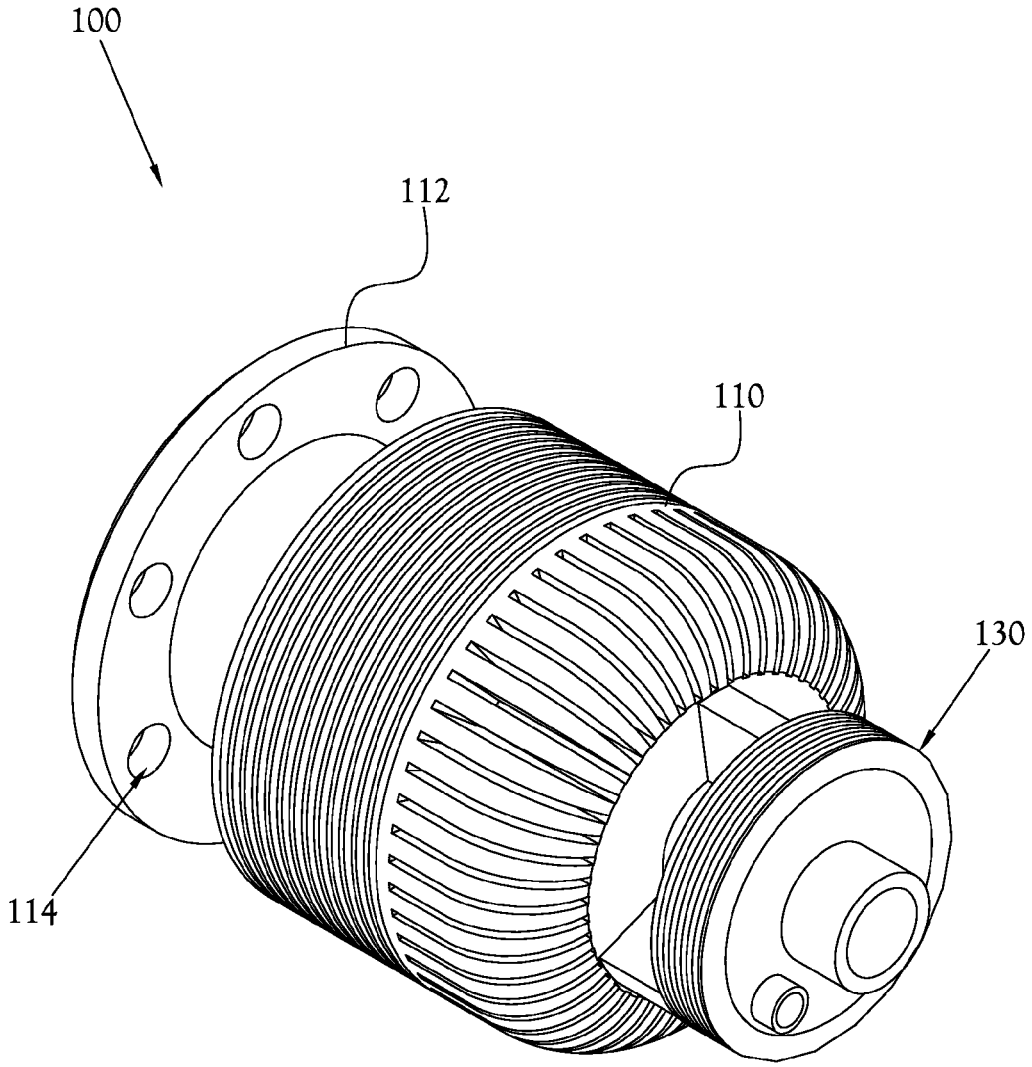
FIG. 1 is a front perspective view illustrating a variable compression cylinder head assembly according to an exemplary embodiment of the present general inventive concept.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept by referring to the figures. However, the present general inventive concept may be embodied in many different forms and should not be construed as limited to the embodiments set forth herein; rather these embodiments are provided so that this disclosure will be thorough and complete, and will convey the scope of the invention to those skilled in the art.

Figure 2:
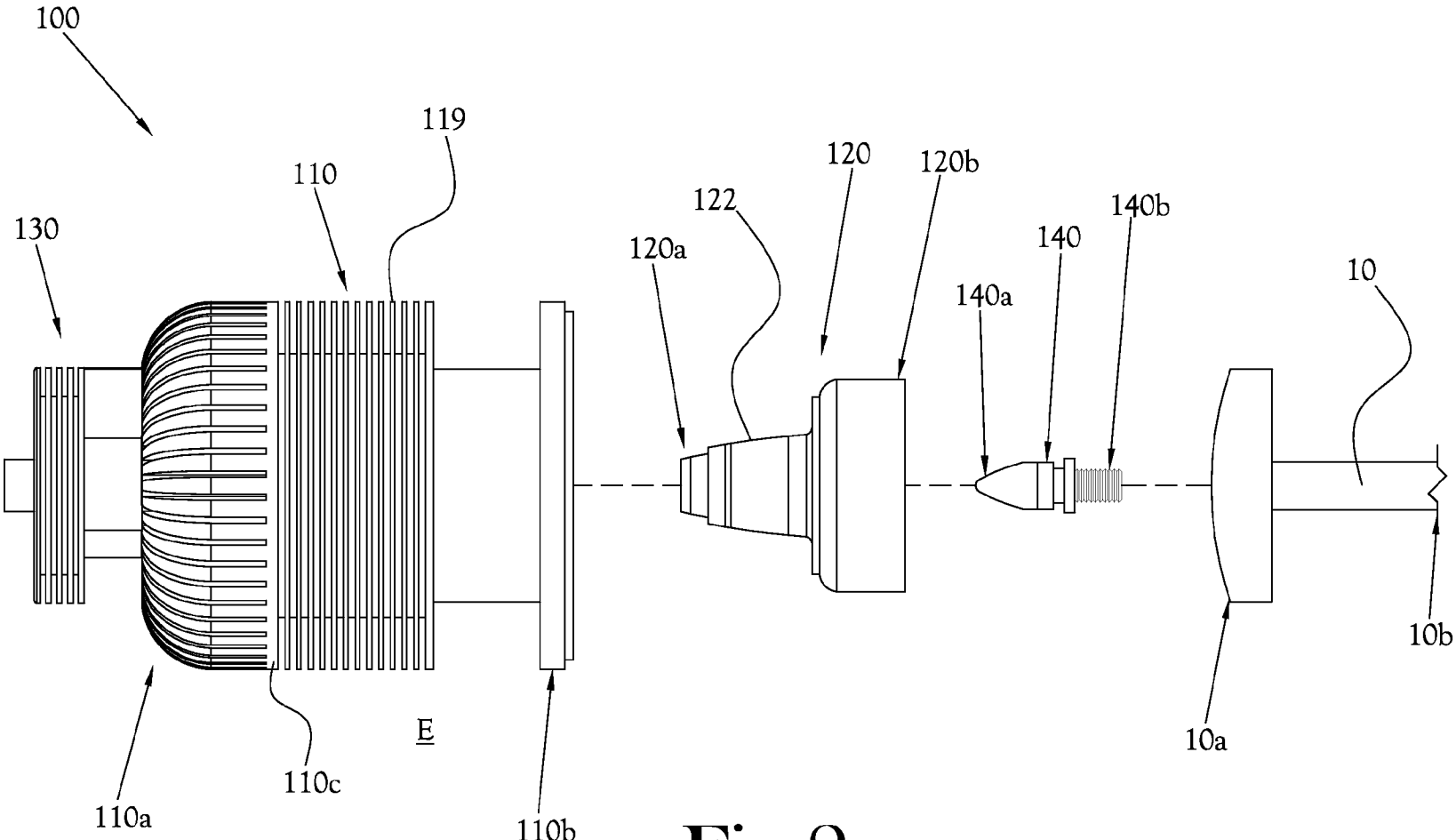
FIG. 2 is an exploded perspective view of the assembly illustrated in FIG. 1.

FIG. 1 is a front perspective view illustrating a variable compression cylinder head assembly 100 according to an exemplary embodiment of the present general inventive concept. FIG. 2 is an exploded perspective view of the assembly 100 illustrated in FIG. 1 and FIG. 3 is a sectional perspective view of the variable compression cylinder head assembly 100 illustrated in FIG. 2.

Figure 3:
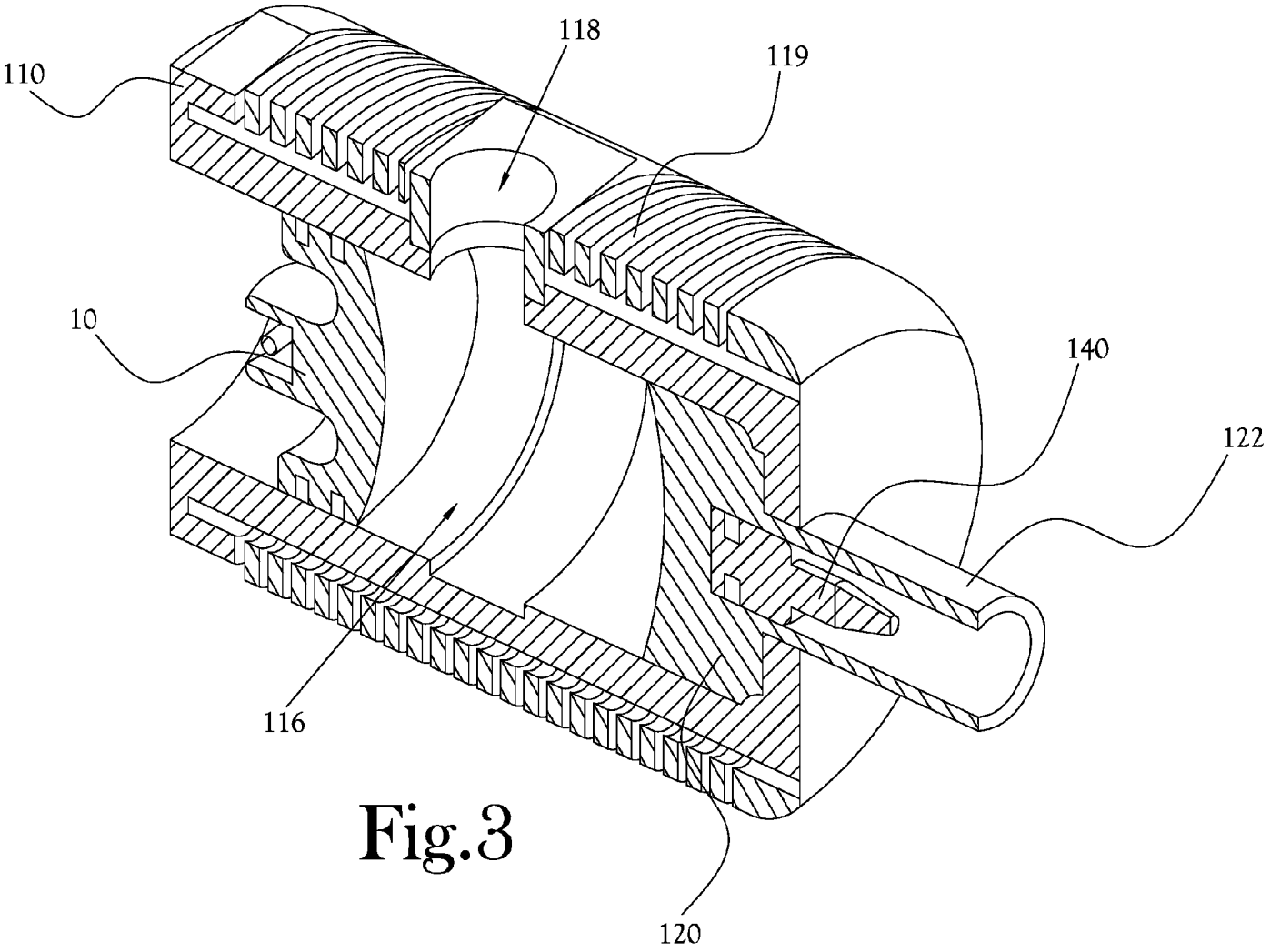
FIG. 3 is a sectional perspective view of the variable compression cylinder head assembly illustrated in FIG. 2.

Referring to FIGS. 1-3, the VCC head assembly 100 includes a variable compression head housing 110, a compression control piston 120, and a variable compression head actuator 130.

In the present exemplary embodiment, the variable compression head housing 110, having a first end 110*a* and an opposing second end 110*b*, includes a head housing base 112 having a plurality of fastening holes 114. In an exemplary embodiment, the VCC head assembly 100 is coupled to an internal combustion engine (not illustrated) having at least one piston 10 by using a plurality of attachment members (not illustrated) affixed to the internal combustion engine through the plurality of holes 114.

Figure 4A:
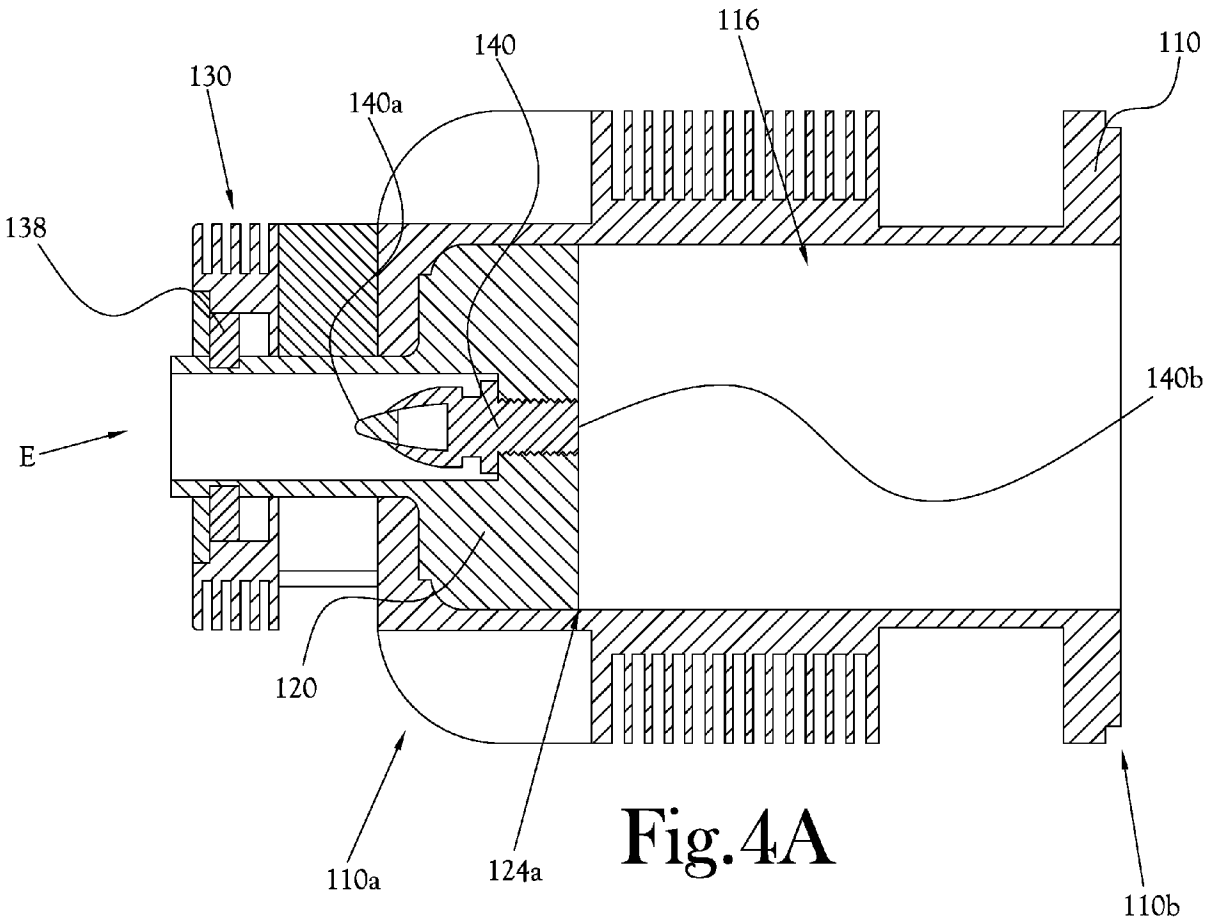
FIG. 4A is a sectional front schematic view of the variable compression cylinder head assembly illustrated in FIG. 1, wherein a compression control piston is at a first position.
Figure 4B:
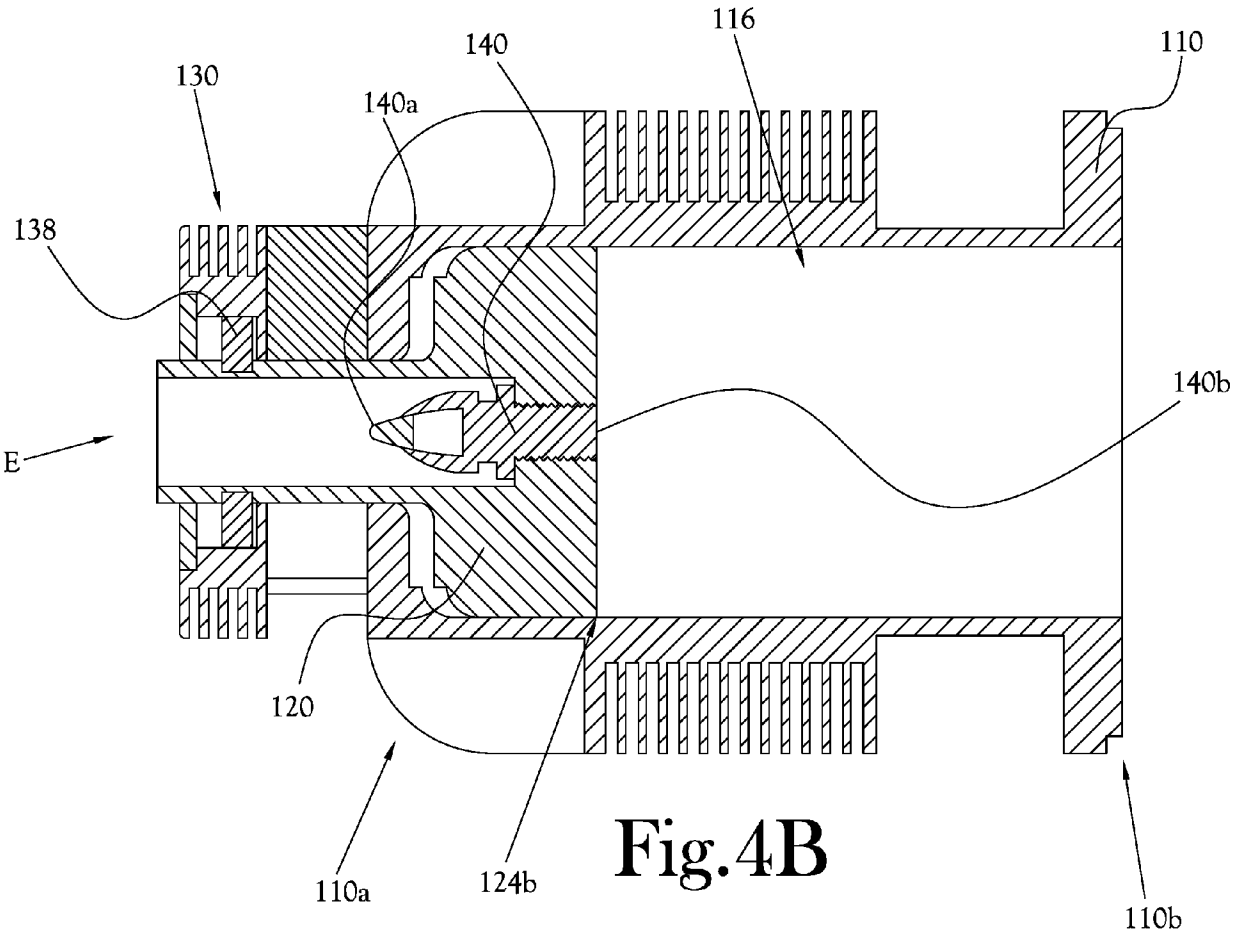
FIG. 4B is a sectional view of the variable compression cylinder head assembly illustrated in FIG. 1, wherein a compression control piston is at a second position.

FIG. 4A is a sectional front schematic view of the variable compression cylinder head assembly 100 illustrated in FIG. 1, wherein a compression control piston 120 is at a first position 124*a*. FIG. 4B is a sectional view of the variable compression cylinder head assembly 100 illustrated in FIG. 1, wherein a compression control piston 120 is at a second position 124*b*.

The head housing 110 includes at least one combustion chamber 116 disposed between the first end 110*a* and the second end 110*b* of the housing 110, an intake port 118, an exhaust port (not illustrated), and at least one ignition device 140.

The combustion chamber 116 may be formed within the variable compression head housing 110 and designed to receive a piston 10. In exemplary embodiments, the combustion chamber 116 may be formed in a substantially cylindrical shape having a diameter corresponding to a diameter of a desired piston 10. However, the present general inventive concept is not limited thereto. That is, in alternative exemplary embodiments, the combustion chamber 116 may be formed in various sizes and shapes as desired.

In the present exemplary embodiment, a volume V1 of the combustion chamber 116 may be defined by the variable compression head housing 110, the piston 10, and the compression control piston 120 at the first position 124*a*. The variable compression head housing 110 is configured to be coupled to various types of internal combustion engines, including linear combustion engines. The variable compression head housing 110 is designed to function with various types of fuels, including diesel, gasoline, and natural gas. However, the present general inventive concept is not limited thereto. That is, in alternative exemplary embodiments, the variable compression head housing 110 may be designed to function with any fuel type by varying a compression ratio of the combustion chamber 116 to correspond with a compression ratio required by the desired fuel.

In exemplary embodiments, the variable compression head housing 110 further includes a plurality of cooling fins 119 integrally formed on an outer surface 110*c* of the housing 110 to increase a rate of heat transfer from the combustion chamber 112 to an external environment E by increasing convection.

Figure 5A:
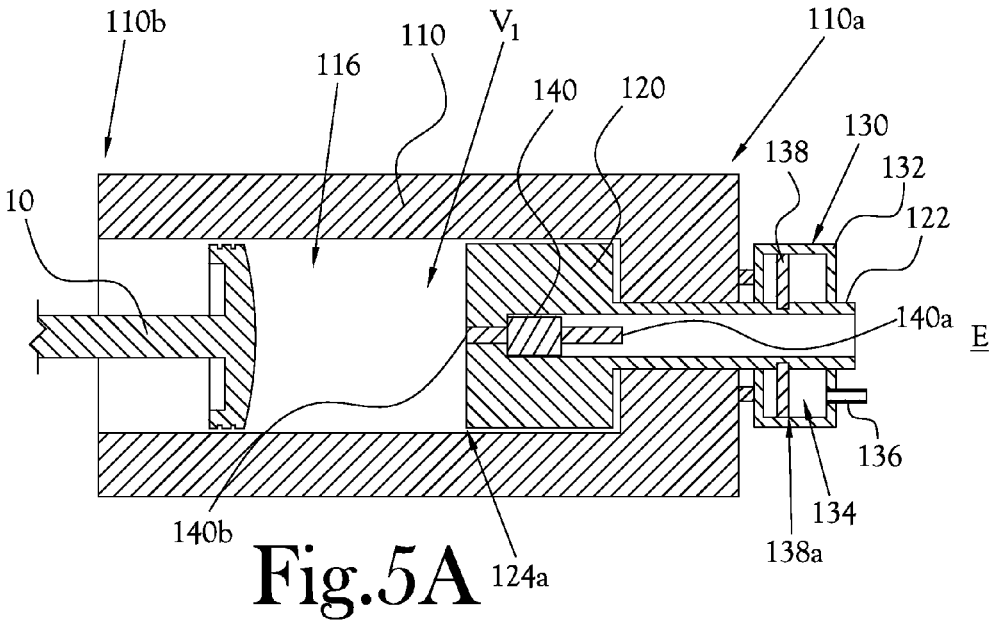
FIGS. 5A and 5B are schematic diagrams illustrating an operation of the variable compression cylinder head assembly illustrated in FIG. 1, according to an exemplary embodiment of the present general inventive concept.
Figure 5B:
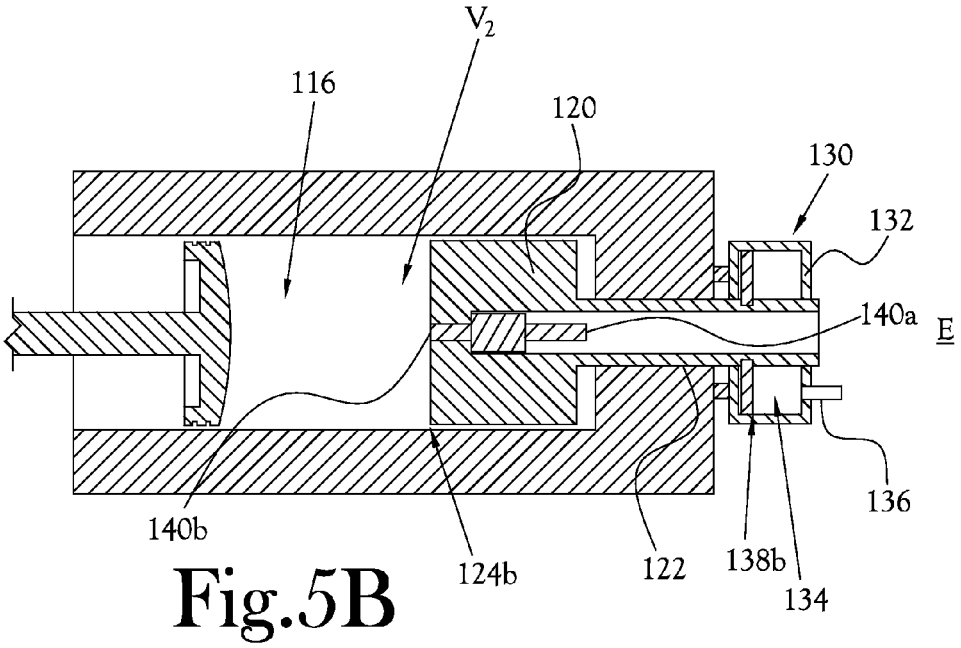

FIGS. 5A and 5B are schematic diagrams illustrating an operation of the variable compression cylinder head assembly 100 illustrated in FIG. 1, according to an exemplary embodiment of the present general inventive concept.

Referring to FIGS. 5A and 5B, the compression control piston 120, which is coupled to the ignition device 140, is disposed within the combustion chamber 116 toward the first end 110*a* of the head housing 110. The ignition device 140 includes a first end 140*a* which faces the first end 110*a* of the head housing 110 and an opposing second end 140*b* which faces the second end 110*b* of the head housing 110. The compression control piston 120 includes an ignition device access port 122 which provides the ignition device 140 with access to the external environment E.

That is, an electrical lead (not illustrated) may be coupled to the first end 140*a* of the ignition device 140 from the external environment through the ignition device access port 122 to generate a spark at the second end 140*b* of the ignition device 140. The second end 140*b* of the ignition device is exposed to the combustion chamber 116 to thereby provide a spark into the combustion chamber 116 and ignite a fuel provided therein. In an exemplary embodiment, the ignition device 140 receives a voltage from an electrical lead coupled to the ignition device 140 which passes through the ignition device access port 122.

In the present exemplary embodiment, the variable compression head actuator 130 includes an actuator housing 132 which defines an actuator reservoir 134, a fluid input/output port 136, and a movable hydraulic plate 138 disposed within the actuator reservoir 134. The hydraulic plate 138 is coupled to the compression control piston 120, such that the hydraulic plate 138 moves in unison with the compression control piston 120 between a first position 138*a* and a second position 138*b*.

The fluid chamber may be used to store hydraulic fluid, oil, or various other incompressible or nearly incompressible fluids. However, the present general inventive concept is not limited thereto.

The fluid input/output port 136 may be in fluid communication with a pump (not illustrated) and a fluid chamber (not illustrated) to input/output fluid into and out of the actuator reservoir 134.

In exemplary embodiments, a cam (not illustrated) driven by the combustion engine is used to drive the pump to pump the fluid stored within the fluid chamber into the actuator reservoir 134, to thereby apply a force onto and move the hydraulic plate 138. When a pressure within actuator reservoir 134 reaches a minimum predetermined value, the hydraulic plate 134 moves from a first position 138*a* toward a second position 138*b* within the actuator reservoir 132*a*. As such, the compression control piston 120 also moves from a first position 124*a* toward a second position 124*b*.

That is, a movement of the hydraulic plate 134 causes the compression control piston 120 to move within the combustion chamber 116 to thereby change a volume of the combustion chamber. As such, by varying the volume within the combustion chamber from a first volume V1, when the compression control piston 120 is at the first position 124*a*, to a second volume V2, when the compression control piston 120 is at the second position 124*b*, a compression ratio of the VCC head assembly can be controlled. In exemplary embodiments, the second volume V2 is less than the first volume V1. However, the present general inventive concept is not limited thereto.

That is, in alternative exemplary embodiments, a position of the compression control piston 120 within the combustion chamber 116 may be controlled mechanically or by using a solenoid to control a volume within the combustion chamber 116.

In an exemplary embodiment, the VCC head assembly 100 which includes a variable compression head housing 110, a compression control piston 120, and a variable compression head actuator 130 is coupled to an internal combustion engine having at least one piston 10 by using a plurality of attachment members affixed to the internal combustion engine through the plurality of holes 114.

Figure 6:
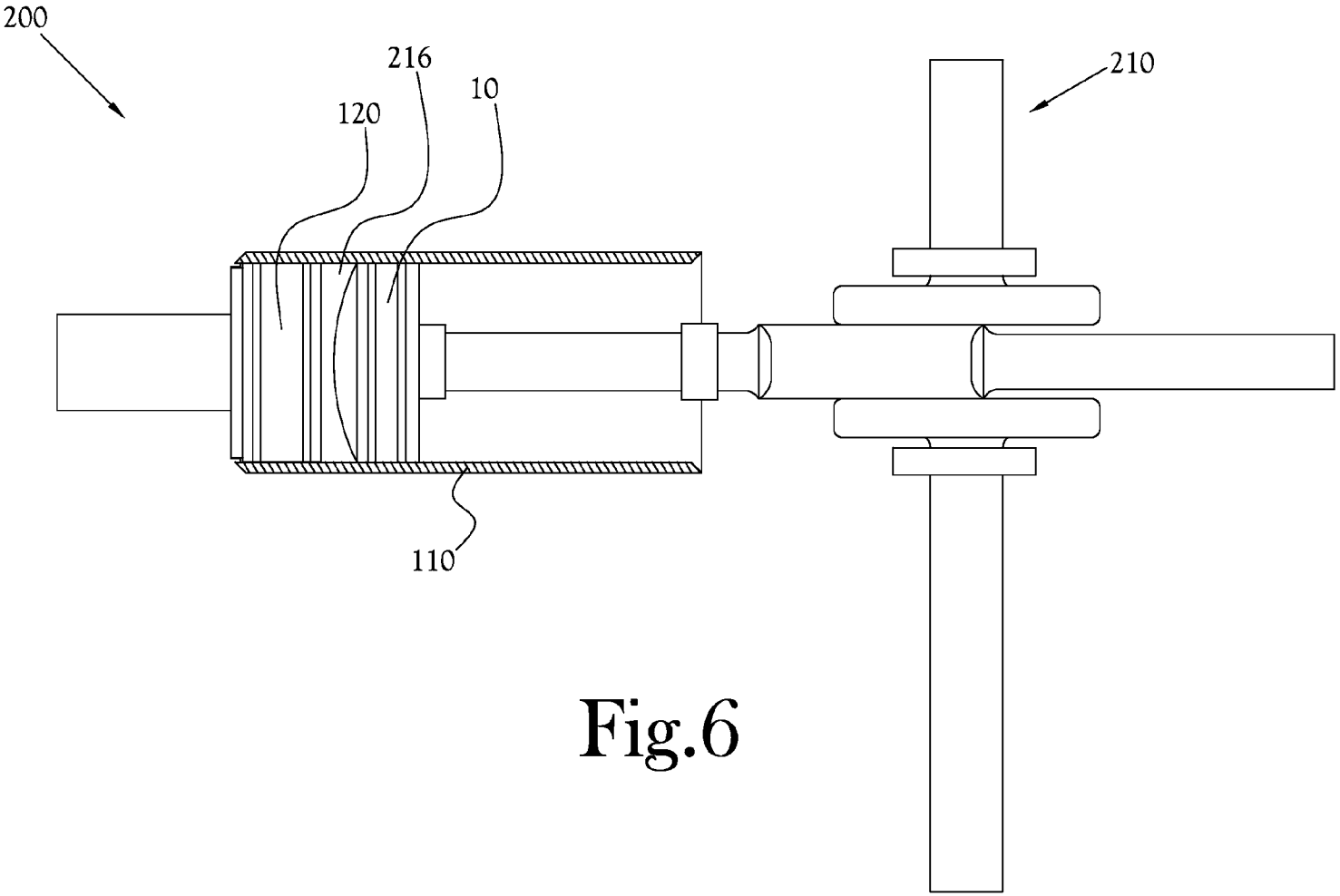
FIG. 6 is a front perspective view illustrating a variable compression cylinder head assembly according to another exemplary embodiment of the present general inventive concept.
Figure 7:
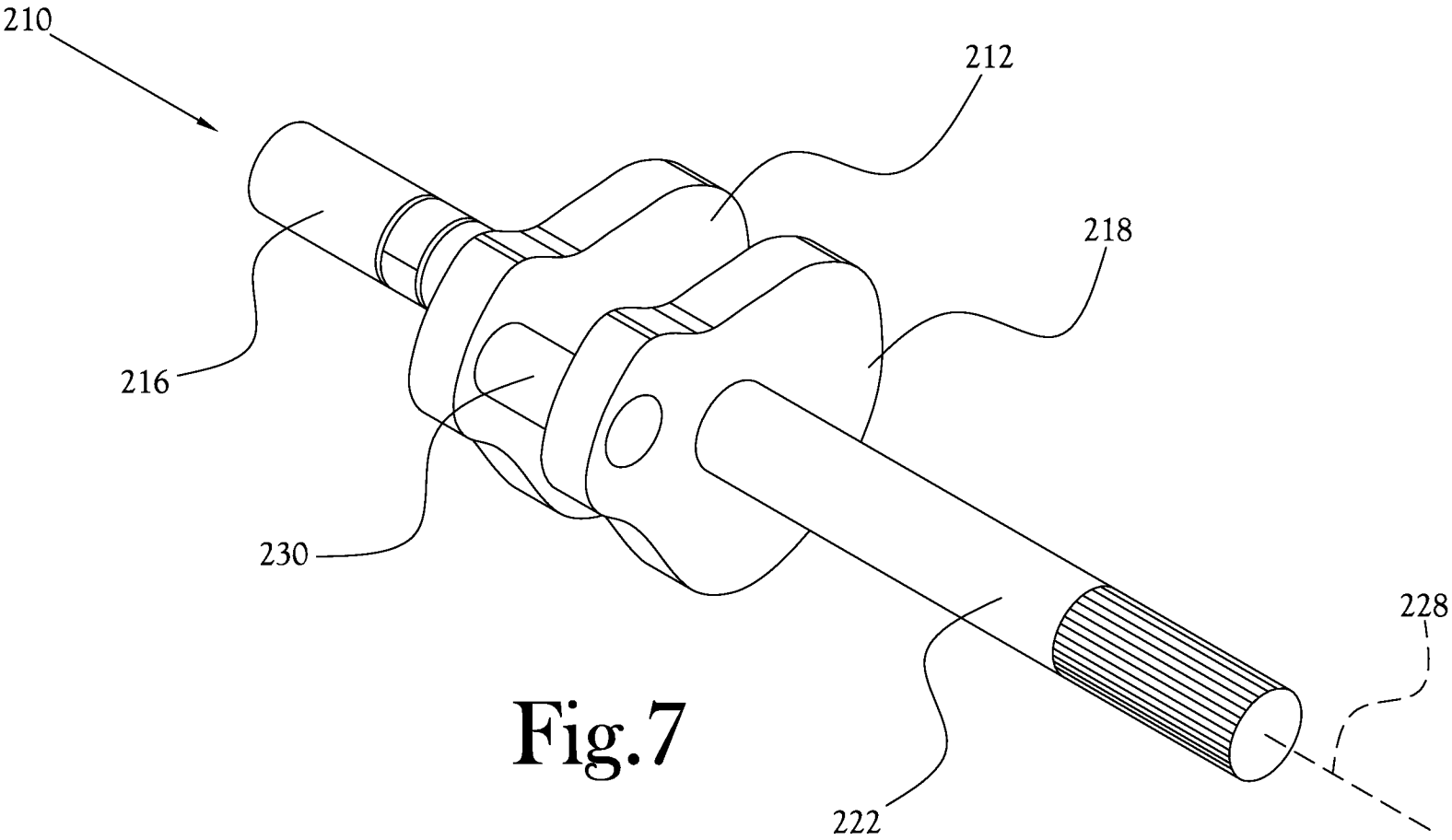
FIG. 7 is a perspective view illustrating a variable compression crankshaft according to an exemplary embodiment of the present general inventive concept.
Figure 8:
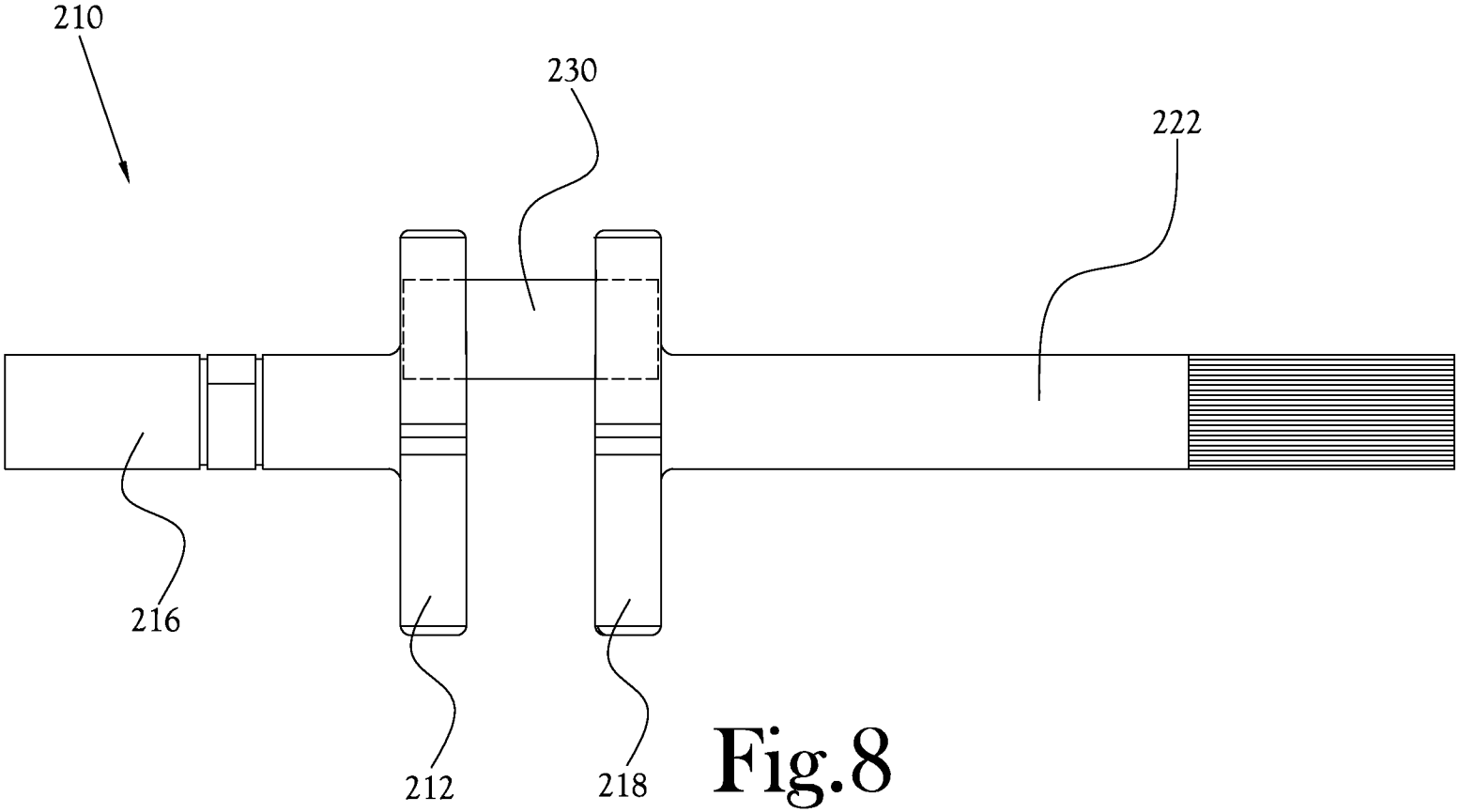
FIG. 8 is a front perspective view illustrating the variable compression crankshaft illustrated in FIG. 7

FIG. 6 is a front perspective view illustrating a variable compression cylinder head assembly 200 according to another exemplary embodiment of the present general inventive concept. FIG. 7 is a perspective view illustrating a variable compression crankshaft 210 according to an exemplary embodiment of the present general inventive concept. FIG. 8 is a front perspective view illustrating the variable compression crankshaft 210 illustrated in FIG. 7

The variable compression cylinder head assembly 200 includes all the elements described above within respect to the previous exemplary embodiment 100 and further includes a variable compression crankshaft 210.

Figure 9A:
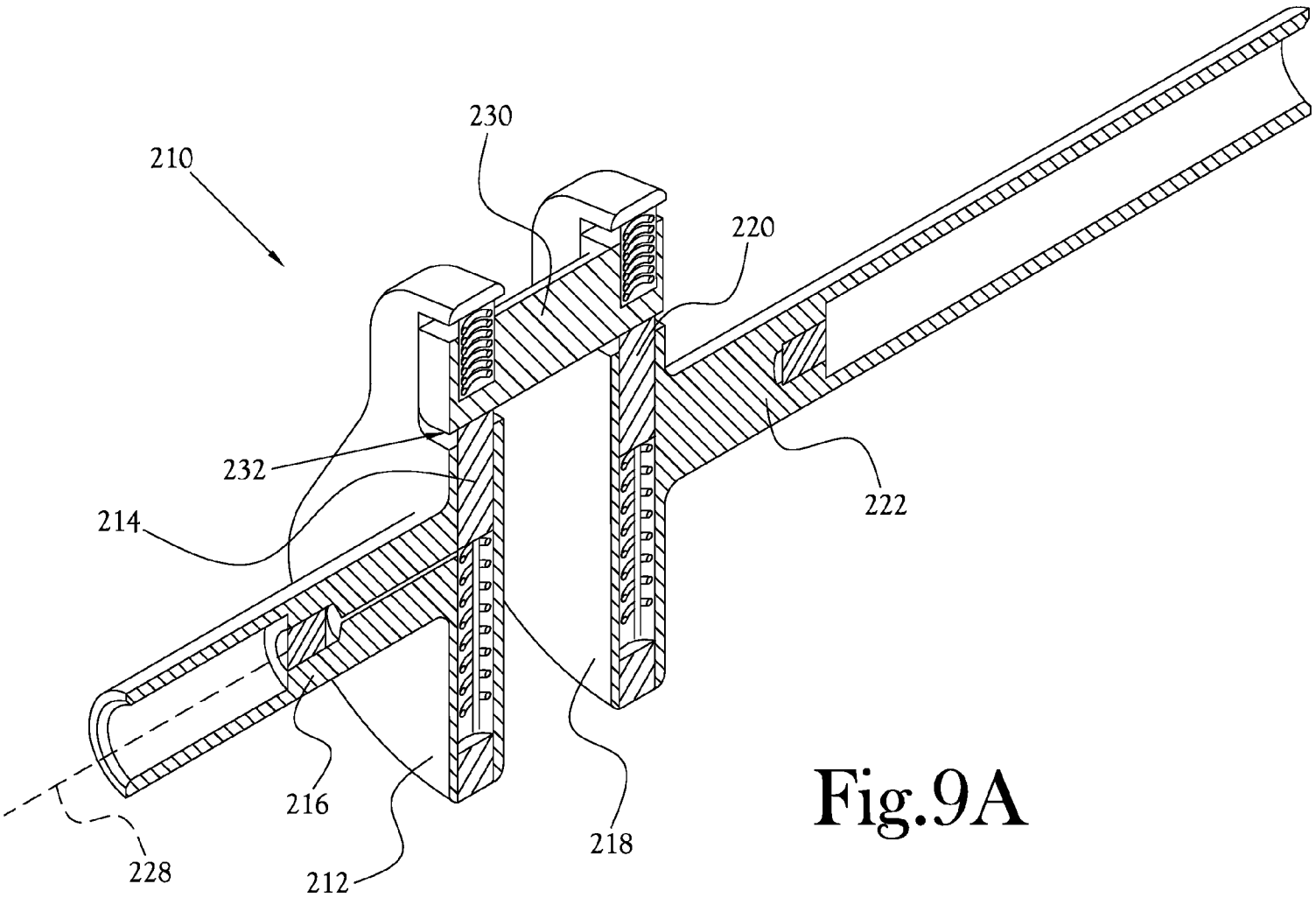
FIG. 9A is a sectional perspective view of the variable compression crankshaft illustrated in FIG. 7, wherein a variable crank throw is at a first position.
Figure 9B:
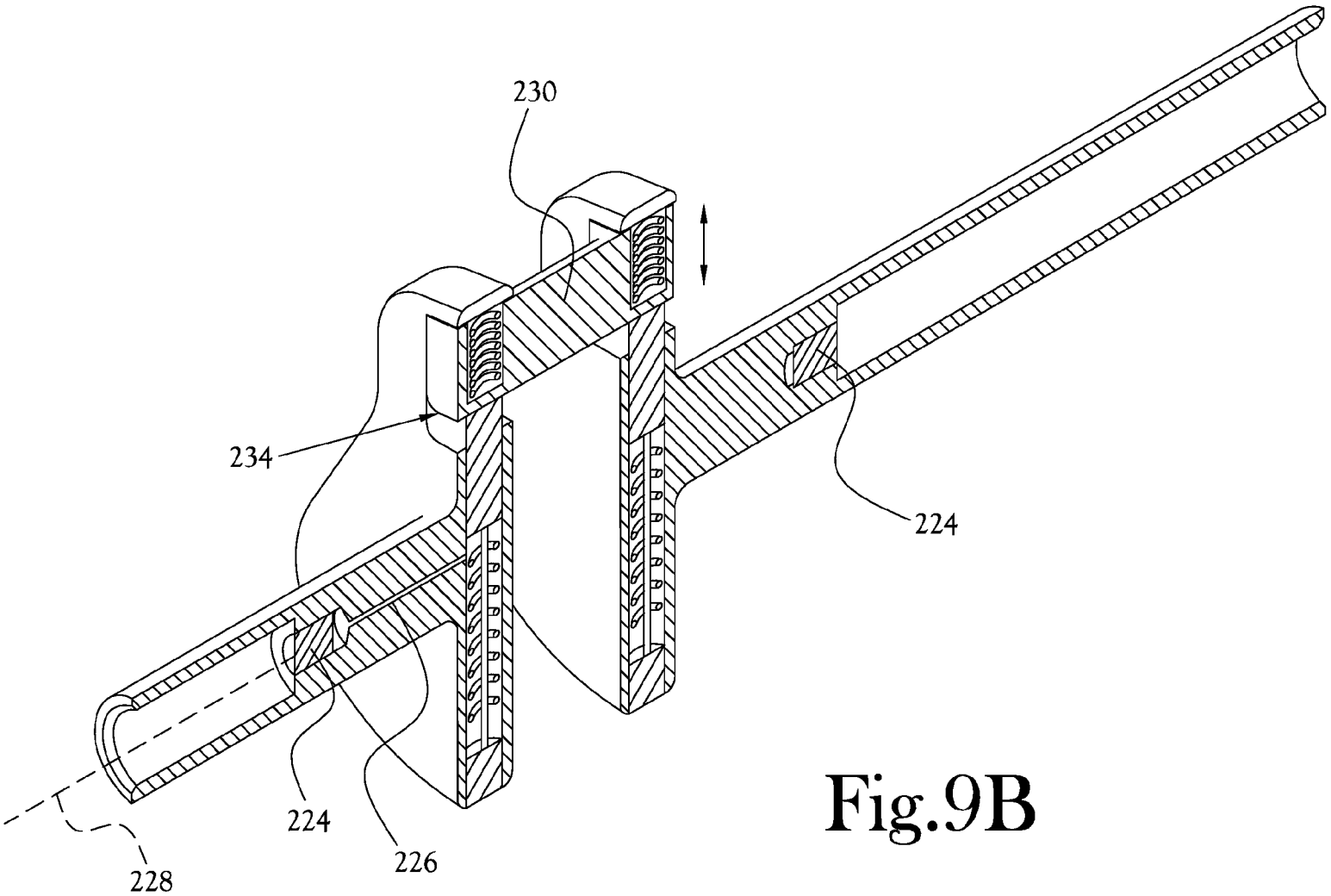
FIG. 9B is a sectional perspective view of the variable compression crankshaft illustrated in FIG. 7, wherein a variable crank throw is at a second position.

FIG. 9A is a sectional perspective view of the variable compression crankshaft 210 illustrated in FIG. 7, wherein a variable crank throw 230 is at a first position 232. FIG. 9B is a sectional perspective view of the variable compression crankshaft illustrated in FIG. 7, wherein a variable crank throw 230 is at a second position 234.

In exemplary embodiments, the variable compression crankshaft 210 includes a first variable crankshaft 212 (i.e., a counter weight housing) having a first variable throw piston 214 disposed therein and coupled to a first control intake 216, and a second variable crankshaft 218 having a second variable throw piston 220 disposed therein and coupled to a second control intake 222.

The variable compression crankshaft 210 further includes a variable crank throw 230 movably coupled to the first and second variable crankshaft 212, 218. The first and second control intake 216, 222 include hydraulic nipples 224 which allow hydraulic fluid to be introduced into the first and second variable crankshaft 212, 218, respectively via port 226. A position of the crank throw 230 relative to rotational axis 228 of the crankshaft can be controlled by pumping a fluid, such as hydraulic fluid, into the first and second variable crankshafts 212, 218 to move the crank throw 230 from the first position 232 toward the second position 234. As the crank throw 230 moves from the first position 232 to the second position 234, a piston 10 coupled to the crank throw 230 also moves from a first position to a second position, thereby varying a volume within a combustion chamber 216. In addition, when the crank throw 230 is at the first position 232, the piston 10 coupled thereto has a short stroke. Conversely, when the crank throw 230 is at the second position 234, the piston has a long stroke.

Figure 10A:
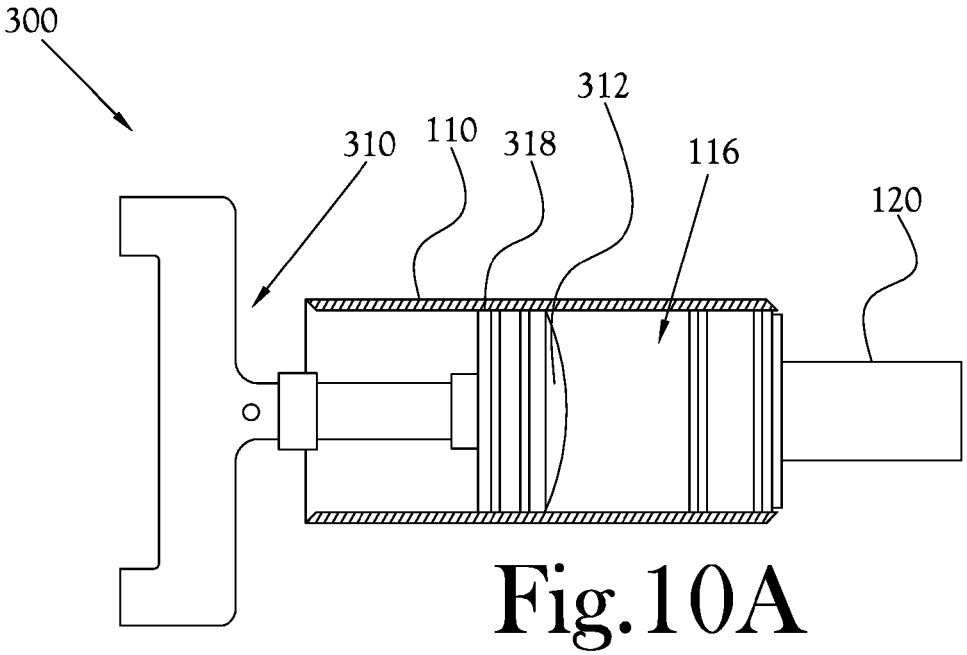
FIGS. 10A and 10B are front perspective views illustrating a variable compression cylinder head assembly 300 according to another exemplary embodiment of the present general inventive concept.
Figure 10B:
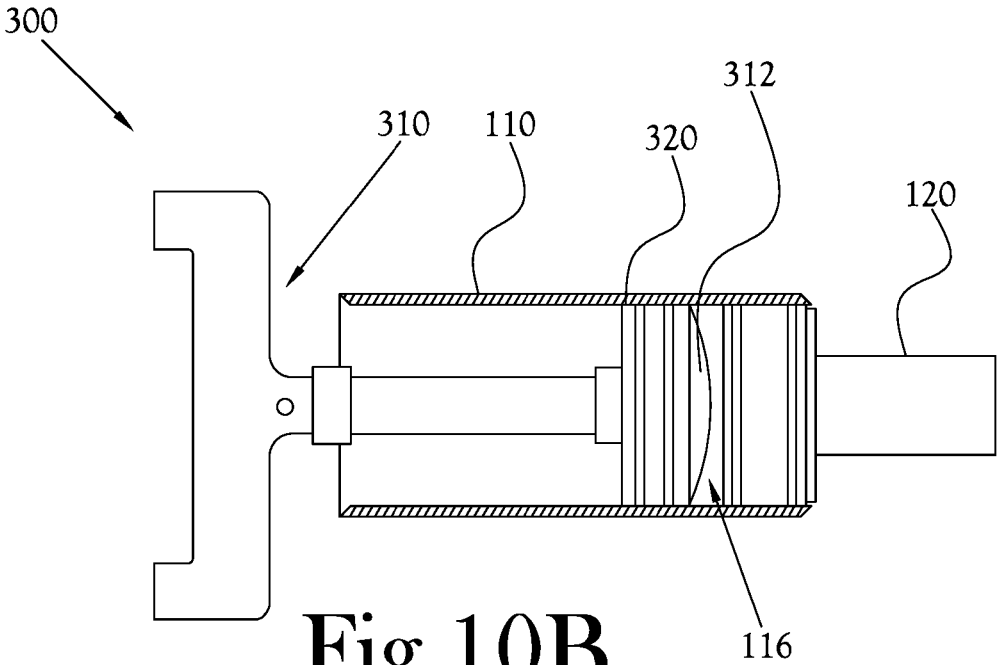

FIGS. 10A and 10B are a front perspective views illustrating a variable compression cylinder head assembly 300 according to another exemplary embodiment of the present general inventive concept. The variable compression cylinder head assembly 300 includes all the elements described above with respect to the previous exemplary embodiments 100 and 200, and further includes a variable piston rod assembly 310.

Figure 11:
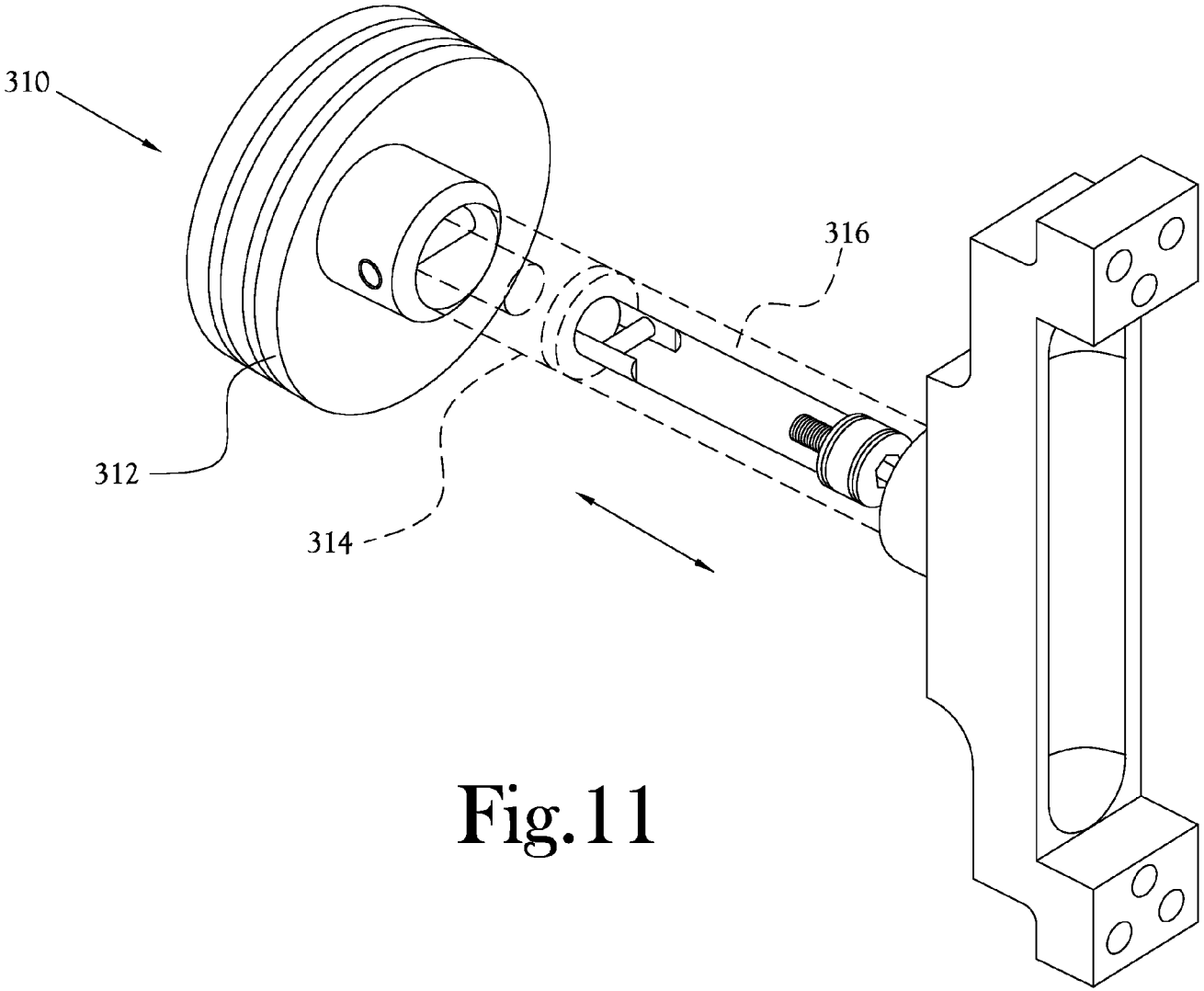
FIG. 11 is a partially hidden front perspective view illustrating a variable piston rod assembly according to an exemplary embodiment of the present general inventive concept.

FIG. 11 is a partially hidden front perspective view illustrating a variable piston rod assembly 310 according to an exemplary embodiment of the present general inventive concept.

In exemplary embodiments, the variable piston rod assembly 310 includes a piston head 312 coupled to a first shaft 314 which, in turn, is slidably coupled into a second shaft 316. The first shaft 314 may expand with respect to the second shaft along the direction indicated when a fluid, such as hydraulic fluid, is introduced into the second shaft 316 via the hydraulic plug coupled thereto. As such, the piston head 312 may be controlled to move between a first position 318 and a second position 320 to thereby control a stroke length, volume, and compression within the variable compression cylinder head assembly 300.

The present general inventive concept provides a variable cylinder head designed and configured to function with conventional internal combustion engines. The variable cylinder head automatically varies a compression ratio within a combustion chamber by controlling a position of a compression control piston within the cylinder.

The present general inventive concept also provides a variable cylinder head which allows for spark and detonation to occur using the same fuel type within the same engine, while significantly reducing emissions and increasing fuel efficiency.

The present general inventive concept also provides a variable compression crankshaft designed and configured to function with the variable cylinder head according to the present general inventive concept. The variable compression crankshaft includes a movable journal which controls a stroke length of a piston, as well as the compression ratio of the engine.

The present general inventive concept also provides a hydraulically operated piston rod designed and configured to function with the variable cylinder head according to the present general inventive concept. The hydraulically operated piston rod includes valves which control an expansion and contraction of the piston rod length to thereby control a stroke length of the piston, as well as the compression ratio of the engine.

The system including a variable cylinder head, a variable compression crankshaft, and a hydraulically operated piston rod according to the present general inventive concept allows for both spark and detonation to occur using the same fuel, within the same engine by controlling compression ratio and/or stroke length, while at the same time significantly reducing emissions and increasing fuel efficiency.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A variable compression cylinder head assembly, and a variable compression crankshaft usable with the variable compression cylinder head assembly, usable with an internal combustion engine having at least one piston, the cylinder head assembly comprising:

a cylinder head housing having a combustion chamber formed therein;

a compression control piston disposed within the combustion chamber and contacting a circumference of the combustion chamber;

a compression head actuator coupled to the cylinder head housing, the compression head actuator comprising:

an actuator housing defining an actuator reservoir;

a first hydraulic fluid port coupled to the actuator housing to receive a first hydraulic fluid;

a movable force plate disposed within the actuator reservoir and coupled through the cylinder head housing with an ignition device access port to the compression control piston, wherein the force plate and the compression control piston are configured to move between a first position and a second position when the first hydraulic fluid enters the actuator reservoir; and the variable compression crankshaft comprising:

at least one counter weight housing having a throw piston chamber formed therein to receive a second hydraulic fluid and coupled to at least one shaft having a second hydraulic fluid port formed therein to Input the second hydraulic fluid;

a first throw piston movable between a first position and a second position disposed within the throw piston chamber; and a variable crank throw coupled to the first throw piston and a second throw piston, and wherein the throw piston and the variable crank throw move between the first position and the second position when the second hydraulic fluid enters the throw piston chamber.

2. The cylinder head assembly of claim 1, wherein a volume within the combustion chamber defined by the at least one piston, the compression control piston and the cylinder head housing is configured to vary as the compression control piston moves between the first position and the second position.

3. The cylinder head assembly of claim 2, wherein the first position of the compression control piston corresponds to a first compression ratio and the second position of the compression control piston corresponds to a second compression ratio.

4. The cylinder head assembly of claim 1, further comprising an ignition device coupled to the compression control piston.

5. The cylinder head assembly of claim 4, wherein a first end of the ignition device is in fluid communication with the combustion chamber and an opposing second end of the ignition device is in fluid communication with an external environment.

6. The cylinder head assembly of claim 1, further comprising a sensor to detect characteristics of fuel provided within the combustion chamber and a controller to automatically control an amount of fluid received within the actuator reservoir based on the detected fuel characteristics.

7. The variable compression crankshaft of claim 1, wherein a volume within the combustion chamber defined by the at least one piston, the cylinder head housing, and the compression control piston is configured to vary as the variable crank throw moves between the first position and the second position.

8. The variable compression crankshaft cylinder of claim 7, wherein the first position of the variable crank throw corresponds to a first compression ratio and the second position of the variable crank throw corresponds to a second compression ratio.

9. The variable compression crankshaft cylinder of claim 2, wherein the first position of the compression control piston corresponds to a first compression ratio and the second position of the compression control piston corresponds to a second compression ratio.

* * * * *